US010016030B2

(12) United States Patent
Simon

(10) Patent No.: US 10,016,030 B2
(45) Date of Patent: Jul. 10, 2018

(54) SAFETY DEVICE FOR JEWELRY ITEMS

(71) Applicant: Sharon Simon, Commack, NY (US)

(72) Inventor: Sharon Simon, Commack, NY (US)

( * ) Notice: Subject to any disclaimer, the term of this patent is extended or adjusted under 35 U.S.C. 154(b) by 168 days.

(21) Appl. No.: 14/932,662

(22) Filed: Nov. 4, 2015

(65) Prior Publication Data

US 2017/0119110 A1 May 4, 2017

(51) Int. Cl.
*A44C 5/20* (2006.01)
*A44C 15/00* (2006.01)

(52) U.S. Cl.
CPC ..... *A44C 5/20* (2013.01); *A44C 15/005* (2013.01)

(58) Field of Classification Search
CPC ..... A44C 5/20; A44C 5/185; A44C 5/18
USPC ..... 63/1.18, 4, 21; 24/3.1, 3.13; 59/79.1
See application file for complete search history.

(56) References Cited

U.S. PATENT DOCUMENTS 3,588,960 A * 6/1971 McClellan ..... G02C 3/003 24/3.3
5,414,907 A * 5/1995 Kiapos ..... G02C 11/02 24/116 A

* cited by examiner

*Primary Examiner* — Jack W Lavinder
(74) *Attorney, Agent, or Firm* — Feldman Law Group, P.C.; Steven M. Crosby

(57) ABSTRACT

The disclosed technology relates to a safety device for a jewelry item. The safety device includes a length of line having a first end and a second end; a first connector, the first connector being a first crimp having a first loop and a first set of crimping jaws, the first loop being fixedly attached to the first end of the length of line; a second connector, the second connector being a second crimp having a second loop and a second set of crimping jaws, the second loop being fixedly attached to the second end of the length of chain; a first elastic band being fixedly attached to the first set of crimping jaws thereby forming a first elastic loop; and a second elastic band, the second elastic band being fixedly attached to the second set of crimping jaws thereby forming a second elastic loop.

2 Claims, 4 Drawing Sheets

SAFETY DEVICE FOR JEWELRY ITEMS

BACKGROUND

The subject matter described herein relates to a safety device for jewelry items.

In the jewelry industry, many type of fasteners are used to attach two ends of a jewelry item together. That is, these fasteners can be used to releasably connect the ends of bracelets, necklaces and the like, e.g., these fasteners can reasonably secure the ends of the jewelry item together. Oftentimes, extended or rough usage of the fastener wears and/or loosens the clasp which can cause the fastener to open or separate resulting in loss of the jewelry without the immediate knowledge of the wearer. In the jewelry industry, there is always a need for jewelry fasteners that are more secure so that jewelry items are not lost when the jewelry item is being worn.

SUMMARY

The disclosed technology relates to a safety device for jewelry items. The safety device can include a length of line, two crimps and two elastic loops. This combination allows the elastic loops to be removably positioned over clasps of a jewelry item, e.g., a necklace or bracelet, so that if the clasp of the jewelry item becomes unintentionally separated while being worn, the safety device secures the jewelry item and prevents loss of the jewelry item.

In one implementation, a safety device comprises: a length of line having a first end and a second end; a first connector, the first connector being a first crimp having a first loop and a first set of crimping jaws, the first loop being fixedly attached to the first end of the length of line; a second connector, the second connector being a second crimp having a second loop and a second set of crimping jaws, the second loop being fixedly attached to the second end of the length of chain; a first elastic band, the first elastic band having a first end and a second end, the first end and the second end of the first elastic band being fixedly attached to the first set of crimping jaws thereby forming a first elastic loop; and a second elastic band, the second elastic band having a first end and a second end, the first end and second end of the second elastic band being fixedly attached to the second set of crimping jaws thereby forming a second elastic loop.

In some implementations, the first elastic loop is removably positioned over a first clasp of a jewelry item and the second elastic band is removably positioned over a second clasp of the jewelry item so that if the first clasp and the second clasp become unintentionally separated, the safety device secures the jewelry item and prevents loss of the jewelry item. In some implementations, the length of line is a metallic chain or an elastic band.

In another implementation, a safety device comprises: a length of chain having a first end and a second end; a first crimp; a second crimp; a first elastic band, the first elastic band being fixedly attached to the first crimp thereby forming a first elastic loop; and a second elastic band, the second elastic band being fixedly attached to the first crimp thereby forming a second elastic loop.

In some implementations, the first elastic loop is removably positioned over a first clasp of a jewelry item and the second elastic band is removably positioned over a second clasp of the jewelry item so that if the first clasp and the second clasp become unintentionally separated, the safety device secures the jewelry item and prevents loss of the jewelry item.

In some implementations, the safety device can further comprise: a first set of crimping jaws incorporated into the first crimp; and a second set of crimping jaws incorporated into the first crimp, wherein the first set of crimping jaws secures the first elastic band to the first crimp the and the second set of crimping jaws secures the second elastic band to the second crimp.

In some implementations, the safety device can further comprise: a first loop incorporated into the first crimp, the first loop fixedly attaching the first crimp to the first end of the length of chain; and a second loop incorporated into the second crimp, the second loop fixedly attach the second crimp to the second end of the length of chain.

In some implementations, the length of line is a metallic chain or an elastic band.

In another implementation, a safety device can comprise: a length of elastic chain having a first end and a second end; a first clamp for forming a first elastic loop on the first end of the length of elastic chain; a second clamp for forming a second elastic loop on the second end of the length of elastic chain, wherein the first elastic loop is capable of being removably positioned over a first clasp of a jewelry item and the second elastic band is capable of being removably positioned over a second clasp of the jewelry item so that if the first clasp and the second clasp become unintentionally separated, the safety device secures the jewelry item and prevents loss of the jewelry item.

The advantage of the disclosed technology is that unintentional openings of jewelry clasp do not result in the loss of the jewelry item. The safety device is also removable and can be switched from one jewelry item to another. Further, the elastic loops make attachment to the jewelry items easy and secure.

DETAILED DESCRIPTION

The disclosed technology relates to a safety device for jewelry items. The safety device can include a length of line, two crimps and two elastic loops. This combination allows the elastic loops to be removably positioned over clasps of a jewelry item, e.g., a necklace or bracelet, so that if the clasp of the jewelry item becomes unintentionally separated while being worn, the safety device secures the jewelry item and prevents loss of the jewelry item.

Figure 1:
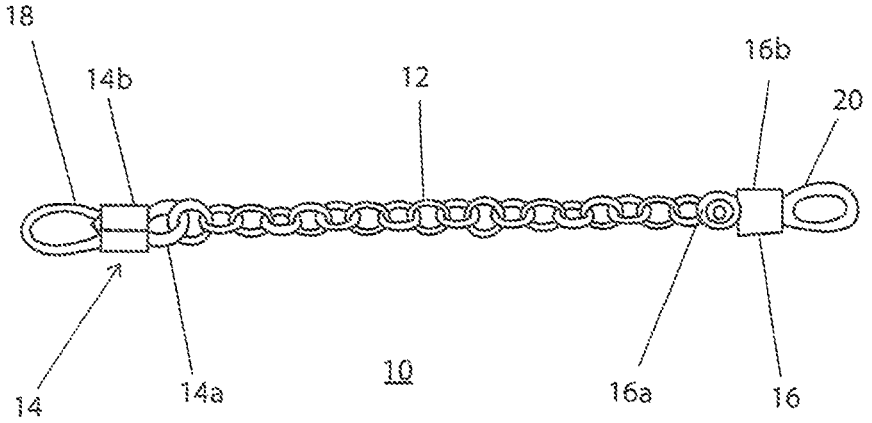
FIG. 1 shows a safety device in accordance with an implementation of the disclosed technology.

As shown in FIG. 1, a safety device 10 can include a length of line 12, two crimps 14, 16 and two elastic loops 18, 20.

The length of line 12 can be any material strong enough to hold the ends of the jewelry item together, e.g. a jewelry chain or an elastic band, etc. The length of line 12 also can be aesthetically pleasing and complement the jewelry item.

In some implementations, the length of line 12 can be ½-4 inches in length but other lengths are contemplated. When choosing the length of line 12 consideration is given in the item to be secured. For example, a safety device 10 for a necklace can be on a longer end of the range because the necklace is hidden from view and is usually clamped together without the vision of the user.

Figure 2:
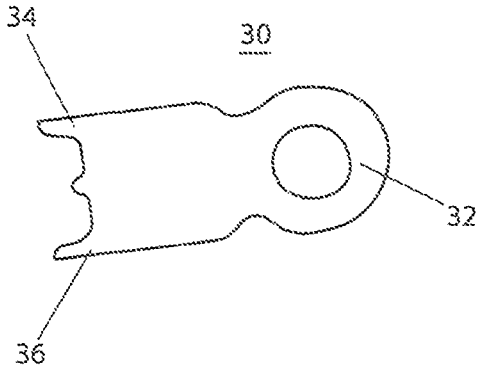
FIG. 2 shows a clamp in accordance with an implementation of the disclosed technology.

As shown in FIG. 2, an unattached crimp 30 has a loop 32 and two collapsible jaws, 34, 36. In use, the loop 32 is capable of being attached to a safety chain and the collapsible jaws are capable of securing elastic safety bands.

As shown in FIG. 1, loops 14*a*, 16*b* of crimps 14, 16 are fixedly secured to either end of a length of chain 12 and collapsible jaws 14*b*, 16*b* of the crimps 14, 16 secure elastic bands to the crimp 14*b*, 16*b*. During construction of the safety device 10, elastic bands can be placed inside jaws 14*b*, 16*b* of the crimp 14, 16 and gently squeezed to secure the elastic band to the crimp 14, 16 thereby forming elastic loops 18, 20. Other methods of securing the elastic bands to the safety device 10 are contemplated.

The elastic loops 18, 20 can be made from, e.g., urethane. Urethane was chosen because (1) it has elastomeric memory and returns to its original shape when stretched, (2) is non-brittle and won't crack and break under impact and shock loading, (3) its resilient and has superior abrasion and impact-resistance qualities, and (4) is versatile and is available in a wide range of durometers and densities.

In one implementation, the elastic loops, 18 20 can be made from an elastic jewelry chain composed of urethane. These elastic jewelry chains are strong and difficult to break. These chains were chosen because the elastic characteristic is strong enough to hold the ends of a jewelry item in case of clasp failure while being stretchable enough to allow it to be pulled over the clasps of the jewelry item. These elastic loops 18, 20 can be manipulated in many positions and return to their original shape without breaking.

Figure 8:
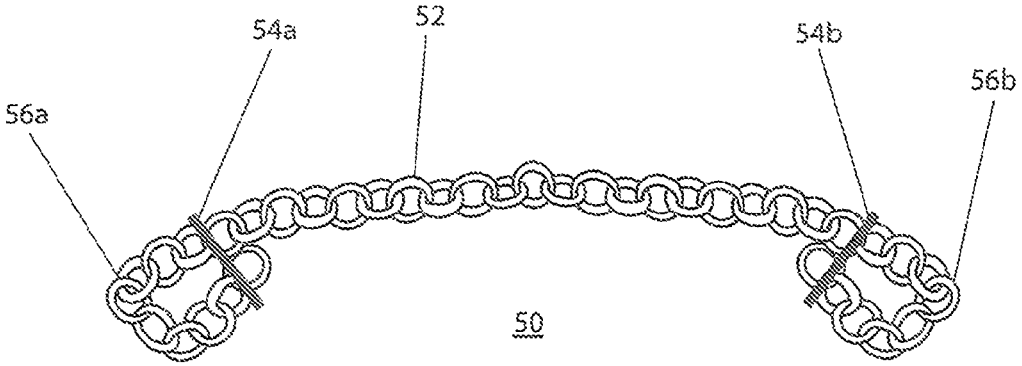
FIG. 8 shows a safety device in accordance with another implementation of the disclosed technology.

For example, the elastic loops 18, 20 can be cut from a spool of 1.2 mm elastic chain. The elastic chain itself can contain eyelets that allow the band to be stretched further. In use, a length of the elastic chain is cut from the spool and the two ends of the elastic chain can be secured within the jaws 14*b*, 16*b* of the crimps 14, 16 thereby forming the elastic loops 18, 20. The size of the elastic loops 18, 20 can be chosen based on a standard clasps used in the jewelry trade, e.g., the elastic loops 18, 20 can have a circumference of ⅛ to 1 inch. The elastic loops 18, 20 are of a size that allows them to snugly fit over a variety of size and shape clasps. That is, the circumference of the elastic loops are smaller than a circumference of the clasp so that the loops need to be stretched over the clasp but allow the loop to return to its original shape after it is applied. In another implementation shown in FIG. 8, a single length of elastic chain 52 can be used with each end of the elastic chain looped back onto itself and crimped with crimps 54*a-b* thereby forming two elastic loops 56*a-b* on either end the elastic chain 52.

Figure 3:
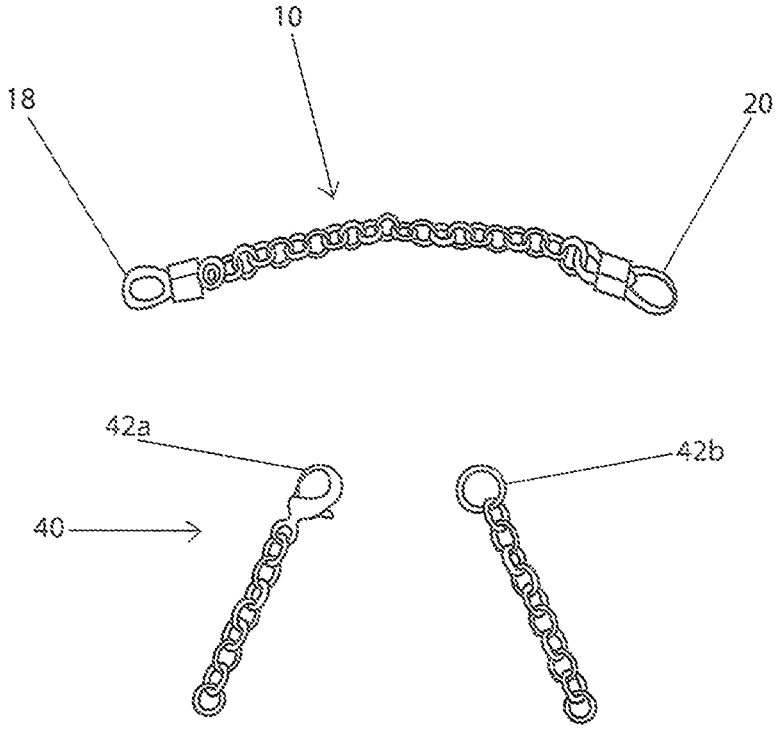
FIGS. 3-6 show a safety device and jewelry item in accordance with an implementation of the disclosed technology.
Figure 4:
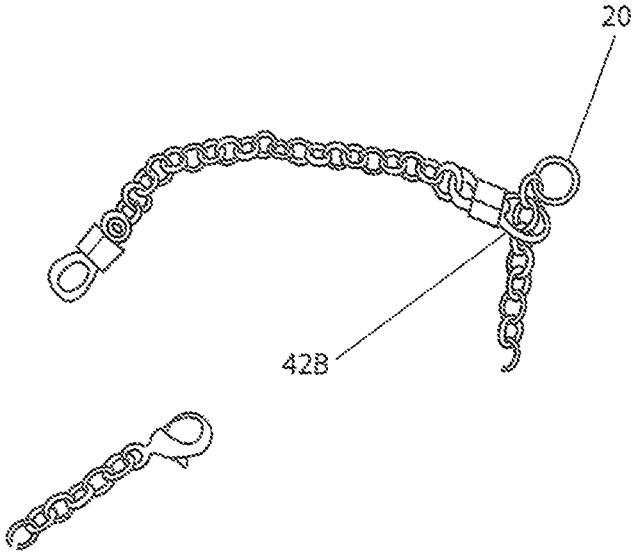
Figure 5:
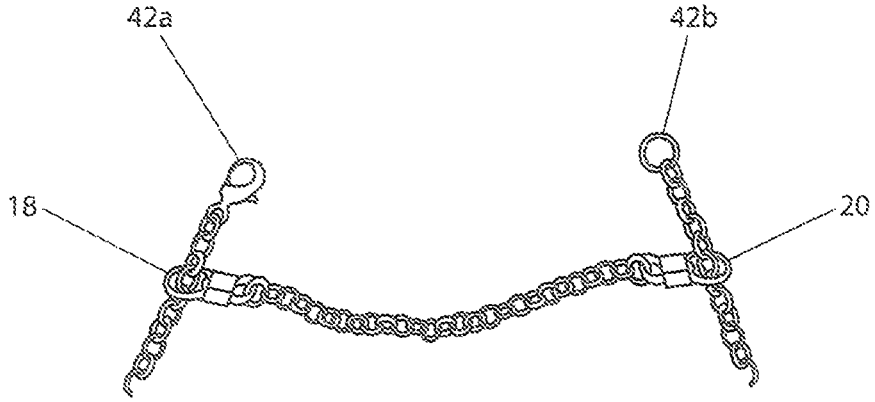
Figure 6:
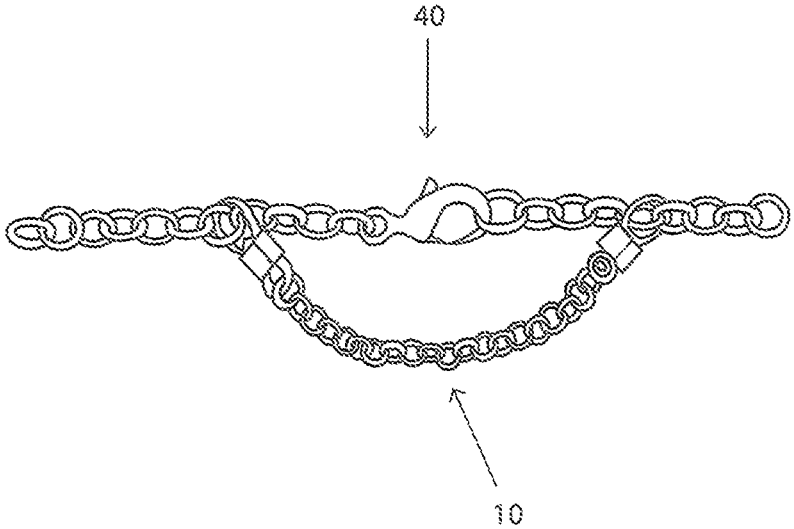

As shown in FIG. 3-6, the method of attaching the safety device 10 to a jewelry item 40 is shown. In FIG. 3, the safety device 10 is brought in close proximity to an opened jewelry item 40 having an attachment mechanism 42*a-b*, e.g., clasps. In FIG. 4, the first elastic loop 18 is stretched over one clasp 42*a* of the jewelry item 40. At this time, a user would bring the jewelry item towards a body part of the user where the jewelry item is to be displayed and wrap the jewelry item around the body part, e.g., a neck or wrist of the user. Once in place, as shown in FIG. 5, the second elastic loop 20 is placed over the other jewelry clasp 40*b*. Then, as shown in FIG. 6, the clasp 42*a-b* are locked to one another. Now, the safety device can secure the jewelry item in case of clasp failure, e.g., a broken clasp or unintentional disengagement.

Figure 7:
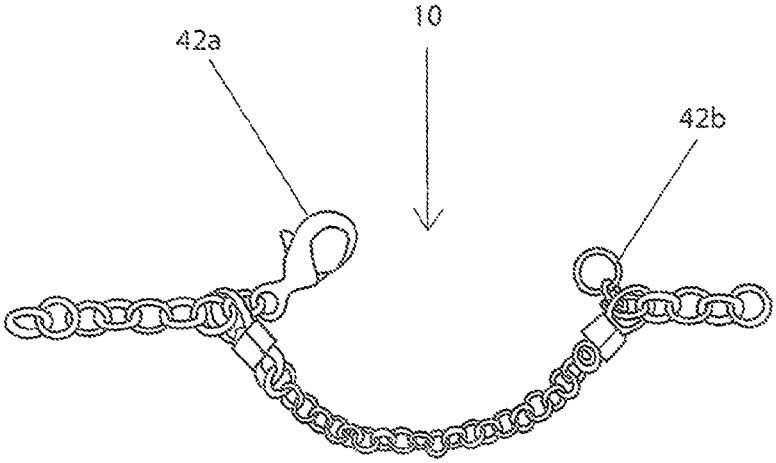
FIG. 7 shows a safety device and jewelry item in accordance with an implementation of the disclosed technology.

FIG. 7 shows the safety clasp holding the ends of the jewelry item together after the clasp failure. That is, if the clasp becomes unattached to each other, the safety device secures the jewelry item and does not allow the jewelry item to be lost.

While presently preferred embodiments have been described for purposes of the disclosure, numerous changes in the arrangement can be made by those skilled in the art. Such changes are encompassed within the spirit of the invention as defined by the appended claims.

The foregoing Detailed Description is to be understood as being in every respect illustrative and exemplary, but not restrictive, and the scope of the disclosed technology disclosed herein is not to be determined from the Detailed Description, but rather from the claims as interpreted according to the full breadth permitted by the patent laws. It is to be understood that the embodiments shown and described herein are only illustrative of the principles of the disclosed technology and that various modifications may be implemented by those skilled in the art without departing from the scope and spirit of the disclosed technology. Those skilled in the art could implement various other feature combinations without departing from the scope and spirit of the disclosed technology. Although the embodiments of the present disclosure have been described with specific examples, it is to be understood that the disclosure is not limited to those specific examples and that various other changes, combinations and modifications will be apparent to one of ordinary skill in the art without departing from the scope and spirit of the disclosed technology which is to be determined with reference to the following claims.

The invention claimed is:

1. A safety device comprising:

a first length of an urethane chain, the first length being cut from a spool of 1.2 mm urethane chain, the urethane chain including eyelets allowing for stretch, the first length having a first end and a second end;

a second length of an urethane chain, the second length being cut from the spool of 1.2 mm urethane chain, the second length of the elastic chain having a first end and a second end;

a first crimp, the first crimp having jaws, the jaws of the first crimp securing the first end and the second end of the first length to the first crimp thereby forming a first elastic loop, the first elastic loop having a circumference of ⅛ to 1 inch;

a second crimp, the second crimp having jaws, the jaws of the second crimp securing the first end and the second end of the second length to the second crimp thereby forming a second elastic loop, the second elastic loop having a circumference of ⅛ to 1 inch; and a length of line, the length of line being ½ to 4 inches, the length of line connecting to the first crimp via a first loop on a first end of the length of line and the length of line connecting to the second crimp via a second loop on a second end of the length of line, wherein the first elastic loop and the second elastic loop are removably positioned over clasps of a jewelry item and can be manipulated in many positions and return to an original shape without breaking.

2. The safety device of claim 1 wherein the length of line is one of a metallic chain or an elastic band.

* * * * *